US005665010A

United States Patent [19]

Mori

[11] Patent Number: 5,665,010

[45] Date of Patent: Sep. 9, 1997

[54] COMPOSITE GOLF CLUB SHAFT

[75] Inventor: S. Floyd Mori, Sandy, Utah

[73] Assignee: Advanced Retrofit Components Associated Leader (in) Golf, Inc., Lehi, Utah

[21] Appl. No.: 598,104

[22] Filed: Feb. 7, 1996

[51] Int. Cl.[6] ..... A63B 53/10; A63B 53/12

[52] U.S. Cl. ..... 473/316; 473/318; 473/323

[58] Field of Search ..... 473/316, 317, 473/318, 319, 320, 321, 322, 323; 273/DIG. 7, DIG. 23

[56] References Cited

U.S. PATENT DOCUMENTS

| | | | |
|---|---|---|---|
| 2,050,554 | 8/1936 | Barnhart | 473/323 |
| 3,313,541 | 4/1967 | Benkoczy | 273/DIG. 7 |
| 3,519,270 | 7/1970 | Baymiller | 473/316 |
| 3,764,137 | 10/1973 | Petro | 473/316 |
| 4,123,055 | 10/1978 | Brill . | |
| 4,319,750 | 3/1982 | Roy . | |
| 4,330,126 | 5/1982 | Rumble | 473/323 |
| 4,674,746 | 6/1987 | Benoit . | |
| 4,725,060 | 2/1988 | Iwagana | 473/319 |
| 5,074,555 | 12/1991 | Meredith . | |
| 5,083,780 | 1/1992 | Walton | 473/320 |
| 5,253,867 | 10/1993 | Gafner . | |
| 5,265,872 | 11/1993 | Tennent | 473/320 |
| 5,316,299 | 5/1994 | Feche et al. . | |
| 5,324,032 | 6/1994 | Minami . | |
| 5,413,338 | 5/1995 | Kawamatsu . | |
| 5,439,219 | 8/1995 | Vincent . | |

FOREIGN PATENT DOCUMENTS

| | | |
|---|---|---|
| 427717 | 4/1935 | United Kingdom . |
| 2053004 | 2/1981 | United Kingdom . |
| 2053698 | 2/1981 | United Kingdom . |
| 2250443 | 6/1992 | United Kingdom . |

*Primary Examiner*—Sebastiano Passaniti
*Attorney, Agent, or Firm*—Mallinckrodt & Mallinckrodt

[57] ABSTRACT

A golf club shaft has the usual handle portion at one end, a golf club head mounting portion at the opposite end, and a tapered intermediate portion therebetween. The tapered intermediate portion includes a substantially inflexible section adjacent the handle portion and a substantially flexible section adjacent the club head mounting portion. With this arrangement, rather than the entire shaft flexing in a substantially smooth curve during a normal swing of the club, the flexing is limited to the substantially flexible section of the club. This provides a club with increased control.

14 Claims, 3 Drawing Sheets

COMPOSITE GOLF CLUB SHAFT

SPECIFICATION

BACKGROUND OF THE INVENTION

1. Field

The invention is in the field of golf club shaft construction.

2. State of the Art

Golf club shafts generally include a handle portion at one end to which a hand grip is secured, and a club head receiving portion at the opposite end to which a club head is secured, with the intermediate portion of the shaft extending between the hand grip and the club head. The shaft is generally tapered between the hand grip and the club head.

Most shafts will flex to some extent, with the newer shafts made of composite materials generally offering a greater degree of flex than older metal shafts. The shafts generally provide a relatively constant flex over their length, a least over the length from the hand grip to the club head. Flex in the club shaft is usually desirable because it provides increased speed as the club head hits the ball because the flex is usually highest at the start of the swing as the club head is initially moved, and as the club head gains speed during the swing, the initial flex decreases adding to the speed of the club. This provides a longer drive. However, when a shaft can flex, it generally also can twist. Upon initiating swing of the club, since the club head extends in unbalanced fashion from one side of the shaft, the shaft is subjected to torque forces which allow the club head and face of the club head to twist. This twisting lessens the control a golfer has when hitting the ball and can lead to slicing or hooking of the ball. Thus, while flex in a shaft is usually desirable to some extent, it affects the control a golfer has in achieving a straight shot.

SUMMARY OF THE INVENTION

According to the invention, a composite golf club shaft is constructed to modify the flex pattern of the shaft. Rather than providing a substantially constant flexing arc over the length of the shaft between the hand grip and the club head, the flexing characteristics of the shaft are modified so that the portion of the shaft adjacent the hand grip, and extending toward the club head, is stiffened so is resistant to flexing, leaving a shorter portion of the shaft toward the club head to flex. In a preferred embodiment of the invention, the club shaft is constructed so that a portion of the shaft extending between about fifteen inches to about eighteen inches from the hand grip end of the shaft resists bending or flexing during swing of the club, with the remaining portion of the shaft toward the club head flexing during swing. It has been found that reducing the length of the shaft over which the flexing of the shaft takes place during a swing does not substantially reduce the distance of a shot, but does substantially increase the control over the shot by the golfer. The shorter flexing portion of the club shaft reduces the twisting or torque of the club head which takes place.

In a composite club shaft, the stiffening of a portion of the shaft to reduce the flexing and twisting or torque of that portion of the shaft is accomplished by thickening the composite material of the shaft through the stiffened portion adjacent the hand grip by adding additional layers of composite material through that portion.

THE DRAWINGS

The best mode presently contemplated for carrying out the invention is illustrated in the accompanying drawings, in which:

FIG. 1 is a side elevation of a golf club using a shaft of the invention;

FIG. 2, a side elevation of the golf club shaft of the invention without the hand grip or club head of FIG. 1;

FIG. 3, a vertical section of the golf club shaft of FIG. 2; and

FIG. 4, a side elevation of the shaft of FIG. 2 showing typical bending characteristics of the shaft.

DETAILED DESCRIPTION OF THE ILLUSTRATED EMBODIMENT

Figure 1:
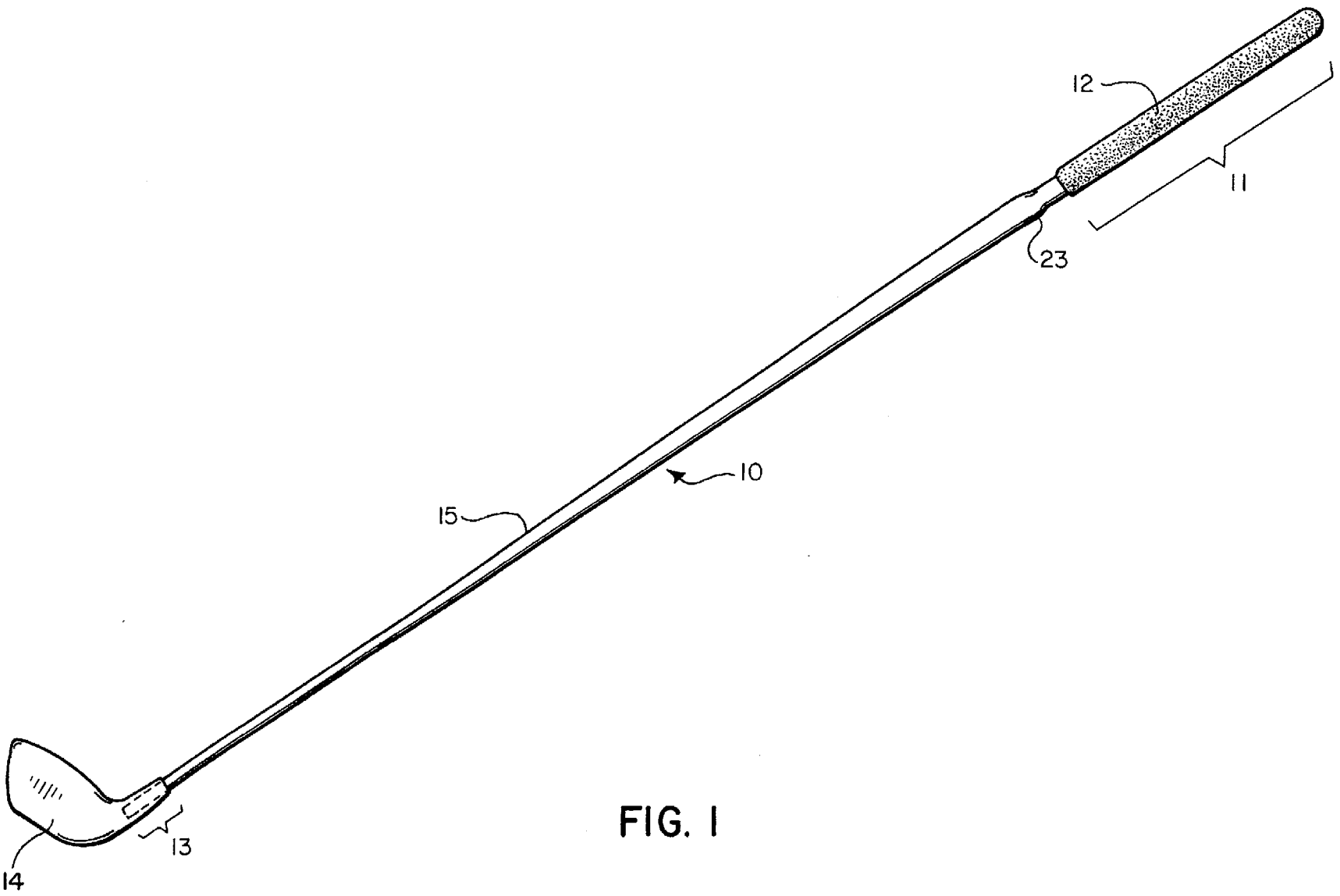

A golf club generally includes a golf club shaft 10, FIG. 1 with a handle portion 11 on which a hand grip 12 is mounted, and a club head mounting portion 13 on which a club head 14 is mounted. An intermediate portion 15 extends between the handle portion 11 and club head mounting portion 13.

Figure 2:
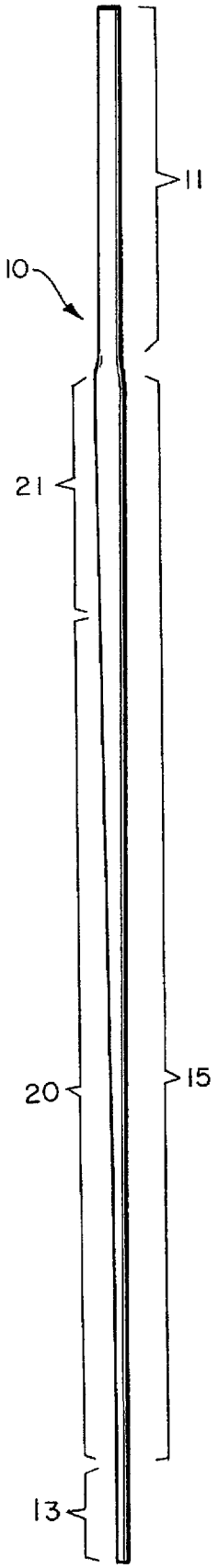
Figure 3:
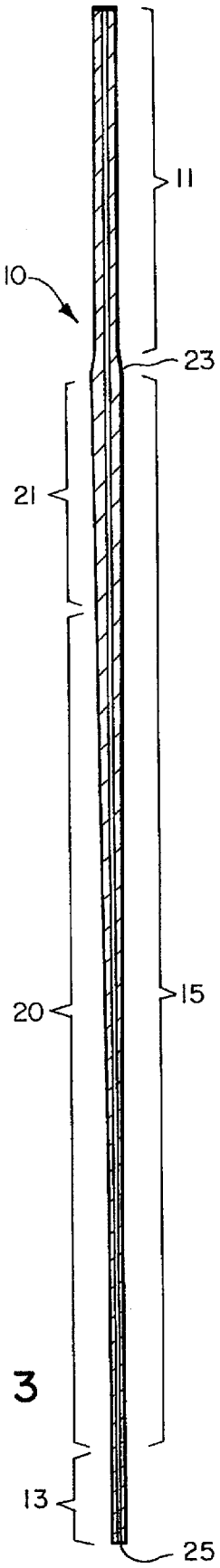

As shown in FIGS. 2 and 3, the handle portion 11 of the shaft 10 is generally of constant diameter, as is the club head mounting portion 13. The intermediate portion 15 is generally tapered from the handle portion 11 to the club head mounting portion 13. In prior art golf club shafts, the intermediate portion 15 generally tapers from a diameter equal to the diameter of the handle portion to the smaller diameter of the club head mounting portion.

In the golf club shaft of the invention, the intermediate portion 15 includes two sections, a substantially flexible lower section 20, and a substantially inflexible upper section 21. These two sections preferably blend together so that the flexibility of the shaft changes smoothly from one section to the other with no sudden or abrupt change. With a composite golf club shaft, i.e., a shaft made of fibers, such as carbon fibers, embedded in a resin material, the flexibility of the shaft can be controlled by the thickness of the composite materials. Thus, an extra thickness of fibers and resin are provided through the substantially inflexible section 21. This causes the substantially inflexible section to have an upper diameter adjacent the handle portion, as at 23, larger than the diameter of the handle portion 11 so that a bulge occurs on the shaft immediately below the hand grip mounted on the handle section. From this larger diameter portion 23, the intermediate portion of the club shaft tapers smoothly to the club head mounting portion 13.

Figure 4:
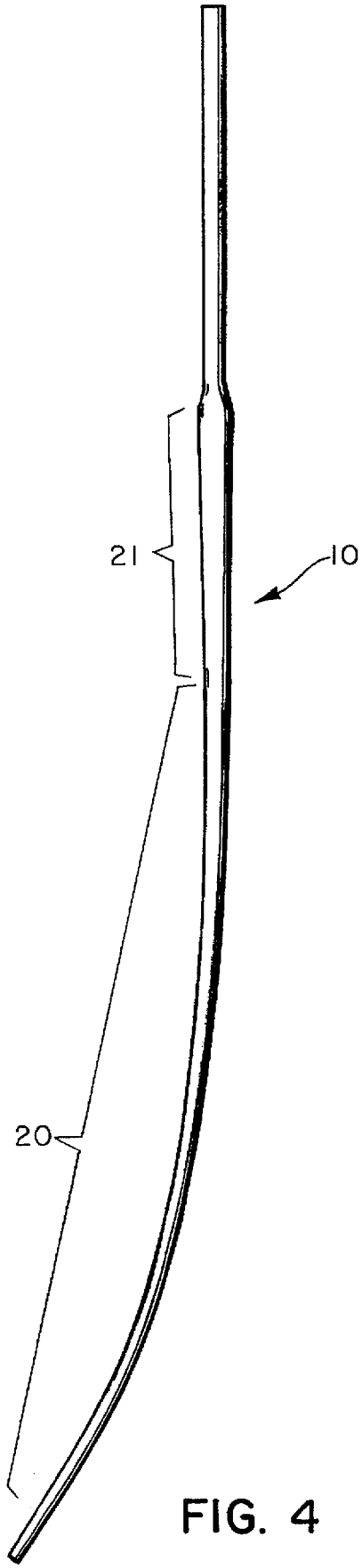

In referring to a substantially flexible section and a substantially inflexible section, it is meant that the flexibility of such sections are such that during a normal swing of the club, the substantially flexible section will flex to some extent while the substantially inflexible section will resist flexing. Thus, as shown in FIG. 4, during a normal swing with a club using the shaft of the invention, the substantially flexible section will flex into an arc as shown at some time during a normal swing, the extent of the arc depending upon the particular swing of the golfer using the club and the stage of the swing, the flex and the arc generally being greater during the initial phases of the swing. During this flexing of the club shaft, the substantially inflexible section remains relatively straight and unflexed. Substantially inflexible does not mean inflexible under other conditions or pressures that might be applied to the club under abnormal circumstances or tests, but only that it is substantially inflexible during a normal swing.

In a typical shaft of the invention, the handle section of constant diameter will be about twelve-and-one-quarter inches long. The substantially rigid section of the intermediate portion will be from about three to five inches long to provide a total length at the upper end of the shaft that does not bend or flex during a normal swing of from about fifteen to about eighteen inches (this section being the total of the length of the handle portion and the substantially inflexible section). The intermediate portion of the club will be about twenty-three to about twenty-eight inches in length, while the club head mounting portion will be about four to about six inches in length. The diameter of the handle portion will be about 0.60 inches in outside diameter while the maximum diameter of the substantially inflexible section will be about 0.70 inches in diameter. The intermediate portion will taper from its maximum diameter to a diameter of about 0.335 inches which is the diameter of the club head mounting portion. These are typical dimensions and may vary considerably depending upon materials used in constructing the shaft, the actual construction of the shaft, and the expected loads on the shaft.

It is preferred that the shaft be configured to make a transition between the handle portion and the maximum diameter of the substantially inflexible section in the form of a smooth curve, as shown.

While the handle portion and the club head mounting portion have been shown and described as being of constant diameter, either could be tapered as desired.

The composite shaft can be constructed in any desired manner, the construction of such shafts being well known. Generally the shaft is constructed on a mandrel which tapers from a large diameter at the handle end of the shaft to a smaller diameter at the club head mounting end of the shaft. This taper is generally necessary so that once the shaft is constructed, the mandrel can be removed from the center of the shaft leaving a hollow shaft with the hollow area 25, FIG. 3, having the same taper as the mandrel. Layers of fiber (such as graphite fibers) and resin material, generally in the form of "prepreg" (a fiber mat material coated with resin) are wrapped around the mandrel and the resin is allowed to harden to form the shaft. The majority of fibers are generally arranged along the length of the shaft, although various wrapping and fiber arrangements can be used. With the normal composite construction, as indicated above, the flexibility of the shaft at any point is a function of its thickness, thicker portions generally being less flexible. Thus, in order to have a one-piece shaft where the shaft can be removed from the mandrel in normal manner, the substantially inflexible section is formed by providing additional wraps of fiber and resin on the outside of the shaft to increase the thickness of the wall of the shaft through that section of the shaft. However, there may be other ways of reducing the flexibility of a section of the shaft without increasing the outside diameter of the shaft through that section.

The construction of the shaft of the invention moves the balance point of the shaft upwardly toward the handle of the club as compared to the traditional shaft construction because additional material is added to the shaft adjacent the handle portion.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A golf club shaft, said shaft having opposite ends and comprising:

a handle portion at one end adapted to receive a hand grip;

a club head mounting portion at the other end adapted to receive a club head;

an intermediate portion extending between the handle portion and club head mounting portion, said intermediate portion having a flexible section adjacent the club head mounting portion that flexes during swing of the golf club and a substantially inflexible section adjacent the handle portion that resists flexing during swing of the golf club, said substantially inflexible section extending from the handle portion a distance of between about three inches to about five inches, and including reinforcing material along such section which increases the diameter of the shaft adjacent the handle portion so that the diameter of the shaft adjacent the handle portion is larger than the diameter of the handle portion.

2. A golf club shaft according to claim 1, wherein the shaft is constructed of composite material, wherein the composite material includes layers of fiber material in a resin, and wherein the reinforcing material comprises additional layers of fiber material and resin.

3. A golf club shaft according to claim 2, wherein the shaft tapers from a maximum diameter adjacent the handle portion to a minimum diameter at the club head mounting portion.

4. A golf club shaft constructed of layers of fiber material in a resin, said shaft having opposite ends and comprising:

a handle portion at one end adapted to receive a hand grip;

a club head mounting portion at the other end adapted to receive a club head;

an intermediate portion extending between the handle portion and club head mounting portion, said intermediate portion having a flexible section adjacent the club head mounting portion that flexes during swing of the golf club and a substantially inflexible section adjacent the handle portion that resists flexing during swing of the golf club, said substantially inflexible section extending from the handle portion a distance of between about three inches to about five inches, and wherein the substantially inflexible section includes sufficient additional layers of fiber material and resin beyond those which are present along the flexible section of the shaft to make such substantially inflexible section substantially inflexible.

5. A golf club shaft according to claim 4, wherein the additional layers of fiber material and resin cause a bulge of the shaft adjacent the handle portion of the shaft.

6. A golf club shaft according to claim 5, wherein the shaft tapers from a maximum diameter in the bulge adjacent the handle portion to a minimum diameter at the club head mounting portion.

7. A method of constructing a golf club shaft from layers of fiber material in a resin, said shaft having a handle portion at one end of the shaft, a club head mounting portion at the opposite end of the shaft, and an intermediate portion extending between the handle portion and club head mounting portion, comprising:

forming a golf club shaft from fiber material in a resin; and adding additional layers of fiber material and resin to the outside of the intermediate portion of the shaft adjacent the handle portion and extending from the handle portion a distance of between about three inches to about five inches toward the club head mounting portion to create a thicker section of the shaft which resists flexing during normal swing of a golf club made with the shaft, the thicker section adjacent the handle portion having a diameter greater than the diameter of the handle portion.

8. A method of constructing a composite golf club shaft according to claim 7, wherein the additional composite material added to the outside of the shaft forms a bulge of the shaft adjacent the handle portion.

9. A golf club shaft constructed of composite material including layers of fiber material in a resin, said shaft having opposite ends and comprising:

a handle portion at one end adapted to receive a hand grip;

a club head mounting portion at the other end adapted to receive a club head;

an intermediate portion extending between the handle portion and club head mounting portion, said intermediate portion having a flexible section adjacent the club head mounting portion that flexes during swing of the golf club and a substantially inflexible section adjacent the handle portion that resists flexing during swing of the golf club, the substantially inflexible section joining the flexible section to provide a smooth change in shaft flexibility from the substantially inflexible section to the flexible section, said inflexible section including sufficient additional layers of fiber material and resin beyond those which are present along the flexible portion of the shaft to make such substantially inflexible section substantially inflexible.

10. A golf club shaft according to claim 9, wherein the additional layers of fiber material and resin cause a bulge of the shaft adjacent the handle portion of the shaft.

11. A golf club shaft according to claim 10, wherein the shaft tapers from a maximum diameter in the bulge adjacent the handle portion to a minimum diameter at the club head mounting portion.

12. A golf club shaft according to claim 9, additional layers of fiber material and resin form a wall of the shaft of maximum thickness adjacent the handle portion of the shaft.

13. A golf club shaft according to claim 12, wherein the shaft wall thickness tapers from the maximum thickness adjacent the handle portion of the shaft to a minimum wall thickness adjacent the club head mounting portion.

14. A golf club shaft according to claim 12, wherein the shaft wall thickness tapers from the maximum thickness adjacent the handle portion of the shaft to a minimum wall thickness at the club head mounting portion.

* * * * *